US009840090B2

(12) United States Patent
Dupre et al.

(10) Patent No.: US 9,840,090 B2
(45) Date of Patent: Dec. 12, 2017

(54) FLATBED PRINTER ASSEMBLY

(71) Applicant: OCE-TECHNOLOGIES B.V., Venlo (NL)

(72) Inventors: Michael Dupre, Venlo (NL); Vincent Darmois, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/276,201

(22) Filed: Sep. 26, 2016

(65) Prior Publication Data

US 2017/0008315 A1 Jan. 12, 2017

Related U.S. Application Data

(63) Continuation of application No. PCT/EP2015/057452, filed on Apr. 7, 2015.

(30) Foreign Application Priority Data

Apr. 11, 2014 (EP) ..... 14164365

(51) Int. Cl.

| | |
|---|---|
| ***B41J 25/34*** | (2006.01) |
| ***B41J 2/51*** | (2006.01) |
| ***B41J 3/28*** | (2006.01) |
| ***B41J 19/00*** | (2006.01) |

(52) U.S. Cl.

CPC . *B41J 2/51* (2013.01); *B41J 3/28* (2013.01); *B41J 19/00* (2013.01); *B41J 25/34* (2013.01)

(58) Field of Classification Search

CPC ..... B14J 3/28; B14J 25/34; B41J 11/22; B41J 19/00

See application file for complete search history.

(56) References Cited

U.S. PATENT DOCUMENTS

| | | | | |
|---|---|---|---|---|
| 5,363,123 | A * | 11/1994 | Petersen | B41J 11/706 346/24 |
| 6,623,100 | B1 * | 9/2003 | Baitz | B41J 3/54 347/37 |
| 2002/0097293 | A1 * | 7/2002 | Castelli | B41J 11/46 347/37 |
| 2004/0189746 | A1 * | 9/2004 | Kawashima | B41J 29/02 347/37 |

(Continued)

FOREIGN PATENT DOCUMENTS

| | | |
|---|---|---|
| EP | 1 842 681 A1 | 10/2007 |
| EP | 2 022 570 A1 | 2/2009 |

*Primary Examiner* — Sharon A Polk

(74) *Attorney, Agent, or Firm* — Birch, Stewart, Kolasch & Birch, LLP

(57) ABSTRACT

A flatbed printer assembly includes a medium support table for supporting a recording medium, the table extending in a first direction and a second direction, the first direction being perpendicular to the second direction; a gantry arranged to be moveable over the medium support table in the first direction; a carriage support movably arranged on the gantry to move over the medium support table in the second direction; a carriage configured to be detachably coupled to the carriage support; a carriage station for holding the carriage, when such carriage is detached from the carriage support; wherein the carriage support is configured to engage and disengage the carriage at the carriage station.

5 Claims, 3 Drawing Sheets

(56) References Cited

U.S. PATENT DOCUMENTS

| | | | | |
|---|---|---|---|---|
| 2005/0264596 | A1* | 12/2005 | Little | B41J 25/005 347/19 |
| 2005/0276646 | A1* | 12/2005 | Morimoto | B41J 3/28 400/62 |
| 2006/0158473 | A1 | 7/2006 | Mills et al. | |
| 2007/0263026 | A1* | 11/2007 | Shang | B41J 2/16508 347/22 |
| 2010/0238248 | A1 | 9/2010 | Doo | |
| 2010/0309492 | A1* | 12/2010 | Baxter | B41J 3/28 358/1.8 |
| 2012/0147074 | A1* | 6/2012 | Ikeda | B41J 3/28 347/8 |
| 2012/0309252 | A1* | 12/2012 | Takeuchi | H01L 51/0005 445/24 |
| 2012/0314011 | A1* | 12/2012 | Wetjens | B41J 2/0057 347/102 |

* cited by examiner

FLATBED PRINTER ASSEMBLY

CROSS REFERENCE TO RELATED APPLICATIONS

This application is a Continuation of PCT International Application No. PCT/EP2015/057452, filed on Apr. 7, 2015, which claims priority under 35 U.S.C. 119(a) to patent application Ser. No. 14/164,365.0, filed in Europe on Apr. 11, 2014, all of which are hereby expressly incorporated by reference into the present application.

FIELD OF THE INVENTION

The present invention generally pertains to a flatbed printer assembly.

BACKGROUND ART

A flatbed printer assembly is known in the art. Such a known printer assembly comprises a medium support table on which a recording medium may be arranged. Such a print assembly is particular advantageous for printing on large rigid media. Such rigid media are, for example, used in the graphics arts for printing signs and posters.

A gantry is provided such that the gantry is moveable over the medium support table and a carriage is moveably supported by the gantry such that the carriage is moveable over the medium support table in a direction perpendicular to the direction of movement of the gantry. By suitably controlling a movement of the gantry and the carriage, a print unit such as an inkjet print head is enabled to position image dots of a recording substance such as ink on the recording medium corresponding to an image to be printed.

In the known flatbed printer assembly, a single carriage is provided. All printing units, e.g. four inkjet print heads for printing ink of four process colors (cyan, magenta, yellow and black, also commonly referred to as CMYK), are arranged on the single carriage.

However, for more sophisticated applications such as common applications in the graphic arts, more colors and special recording substances (varnish, metallic inks, etc.) may be needed. In such case, more print units are required. Increasing the number of print units increases the weight of the carriage and the gantry. As a consequence, high demands are put on the drive units, driving the movement of the carriage and/or the gantry. Moreover, accurately positioning while maintaining (or preferably increasing) a print speed becomes virtually impossible or at least commercially unattractive due to relatively high costs.

Still, it is desirable to have a flatbed printer assembly that is enabled and configured to print on rigid media using a large variety of recording substances.

SUMMARY OF THE INVENTION

In an aspect of the present invention, a printer assembly according to claim 1 is provided. In the flatbed printer assembly of the present invention, the carriage is controllably detachable from the gantry. Therefore, the gantry is provided with a carriage support. At a carriage station, a carriage may be engaged by the carriage support. After engagement, the carriage is functionally coupled to the gantry and can be used for printing.

The flatbed print assembly allows moving an engaged and supported carriage to the carriage station and disengaging the carriage at the carriage station. Moreover, another carriage, for example being provided with print units configured to print other recording substances, may be engaged and—after coupling to the carriage support—printing may be continued using such other recording substances.

Engaging and coupling includes a mechanical coupling between the carriage support and the carriage. Further, an electrical coupling may be needed to provide energy to the printing unit (or other kind of unit) that is arranged on the carriage. Further a data connection, including control data and/or image data, may be established, either a wired connection or a wireless connection. Wired connection may include an electrical coupling or an optical coupling using e.g. a fiber optical cable. A wireless connection may be a short-range high-bandwidth connection. A suitable connection may be easily selected by the person skilled in the art. For identification of the unit arranged on the carriage, it is contemplated to use an RFID tag on the unit and a RFID reader provided on the gantry or carriage support. The RFID tag may be configured to provide any suitable information such as properties of the unit and even of the kind of ink, for example.

Further, engaging and coupling may also include a fluid coupling for recording substance (e.g. ink) supply, if a reservoir is not provided on the carriage. Providing the reservoir off-carriage is preferred in view of the total weight of the carriage, but a reservoir may be arranged on the carriage to simplify the construction of the printer assembly.

In an embodiment, the flatbed printer assembly may comprise at least two carriages and the carriage station is provided with at least two carriage holding sections. Each carriage may be provided with different units, such as print units or non-printing units, e.g. a cutting unit, in any case a unit not configured to provide image dots, but configured to perform any other operation. The print units may be inkjet print heads, for example.

Still, multiple carriages may be provided with similar or same print units. For example, two carriages may each be provided with four inkjet print heads with CMYK inks. In such specific embodiment, one carriage may be coupled to the carriage support for printing operation, while the other carriage is arranged at the carriage station. The carriage station may be provided with a printing unit maintenance assembly for performing a maintenance operation, thereby improving the productivity of the printer assembly as a maintenance operation does not require interruption of the printing operation. A maintenance operation may include a nozzle plate cleaning operation or an ink fill operation (e.g. if the ink reservoir is arranged on the carriage) or any other maintenance operation.

In an embodiment, the flatbed printer assembly comprises a first gantry and a second gantry, each gantry being provided with at least one carriage support configured to engage and disengage the carriage at the carriage station. A dual gantry design is specifically advantageous, since the first and the second gantry can share the carriages and can thus both be in operation at the same time, thereby improving productivity.

In order to provide a good image quality, the image dots provided by printing units arranged on separate carriages need to be accurately aligned. For accurate alignment, it is needed to at least know the position of the printing unit after it has been coupled to the carriage support. In an embodiment, the flatbed printer assembly is provided with a position detection system, wherein the position detection system is configured to accurately determine a carriage position relative to the carriage support and wherein the flatbed printer assembly is configured to accurately position the carriage relative to the medium support table by taking into account the determined carriage position. Several methods and systems for detecting/determining a relative position between two elements are known and may be suitable selected by a person skilled in the art. For example, a position of the carriage relative to a reference position defined on the carriage support may suitably provide the relative position. This relative position may then be used by a control unit to determine and control the movement of the gantry and the carriage support such that droplets ejected by a printing unit on the carriage are positioned accurately, thereby ensuring accurate alignment with previously positioned droplets (image dots).

In another embodiment, the flatbed printer assembly is provided with a position alignment system, wherein the position alignment system is configured to accurately position the carriage relative to the carriage support. Instead of determining a relative position, the carriage support and the carriage may be configured to correctly position relative to each other. Passive mechanical means may be employed, such as a V-groove and a mating pin, or similar means. Alternatively or additionally, active means such as a motorized drive or voice coil based system may be used to shift and/or rotate the carriage and the carriage support relative to each other until they are aligned in accordance with a predetermined relative position.

In yet another embodiment, the flatbed printer assembly is provided with a calibration station, the calibration station being configured to calibrate a position of the print unit arranged on the carriage relative to the medium support table. In this embodiment, the alignment between the carriage and the carriage support is not accurately controlled or determined, but the resulting alignment is calibrated. For example, after engagement and coupling of the carriage to the carriage support, the carriage is moved towards a calibration station, which may or may not be part of the carriage station. At the calibration station, the printing unit, for example, is actuated and a position of the resulting dots is determined. Based on the result, the relative position of the carriage and carriage support may be adapted or the control unit may be provided with calibration data in order to take such data into account upon control of a later printing operation.

In a particular embodiment, the carriage comprises an outer carriage frame and an inner carriage frame. The outer carriage frame is configured to be coupled to the carriage support. The inner carriage frame supports the operative units, i.e. the printing unit and/or non-printing unit. The inner carriage frame is moveably supported by the outer carriage frame. Having determined a relative position between the outer carriage frame and the carriage support, the position of the inner carriage frame may be adjusted to position the units supported by the inner carriage frame accurately relative to the carriage support.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
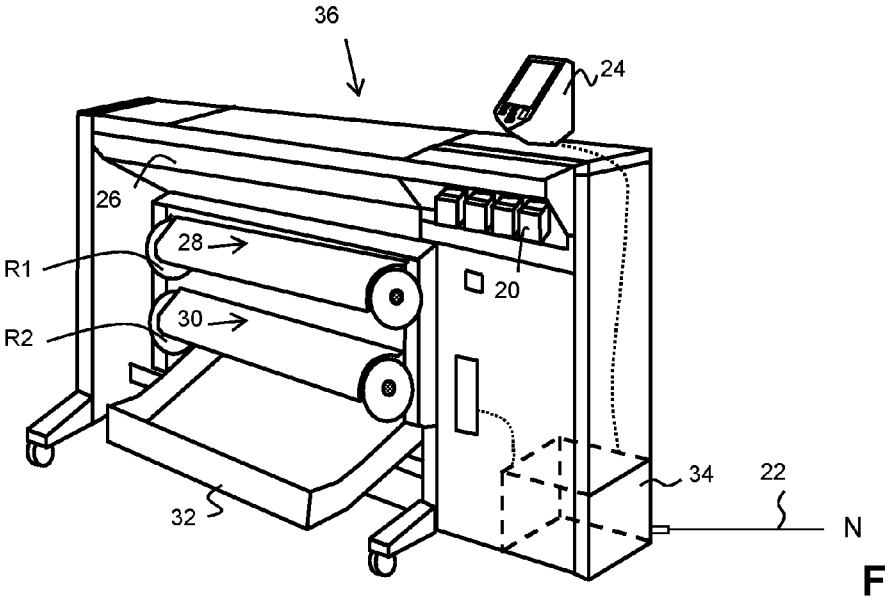
FIG. 1A is a perspective view of a first embodiment of an inkjet printing apparatus.

The present invention will now be described with reference to the accompanying drawings, wherein the same reference numerals have been used to identify the same or similar elements throughout the several views.

Figure 1B:
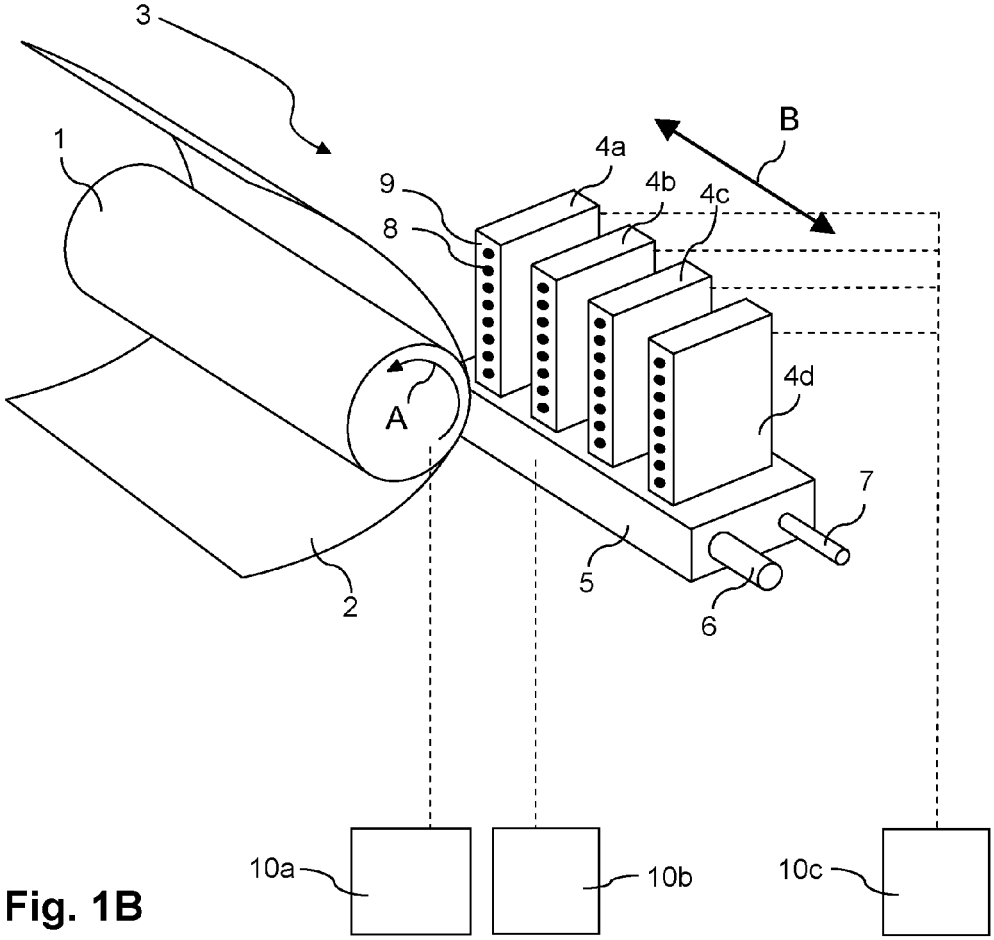
FIG. 1B is a schematic perspective view of an inkjet printing assembly suitable for use in the inkjet printing apparatus of FIG. 1A.

FIG. 1A shows an inkjet printing apparatus 36, wherein printing is achieved using a wide format inkjet printer. The wide-format inkjet printing apparatus 36 comprises a housing 26, wherein the printing assembly, for example the ink jet printing assembly shown in FIG. 1B is arranged. The inkjet printing apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format inkjet printing apparatus 36 furthermore comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The inkjet printing apparatus 36 may optionally be connected to a network N. The connection to the network N is diagrammatically shown in the form of a cable 22, but nevertheless, the connection could be wireless. The inkjet printing apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print head carriage 5. The scanning print head carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material. The scanning print head carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print head carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print head carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The print head carriage 5 is guided by guiding means 6, 7. These guiding means 6, 7 may be rods as depicted in FIG. 1B. The rods may be driven by suitable driving means (not shown). Alternatively, the print head carriage 5 may be guided by other guiding means, such as an arm being able to move the print head carriage 5. Another alternative is to move the image receiving material 2 in the main scanning direction B. Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 1C:
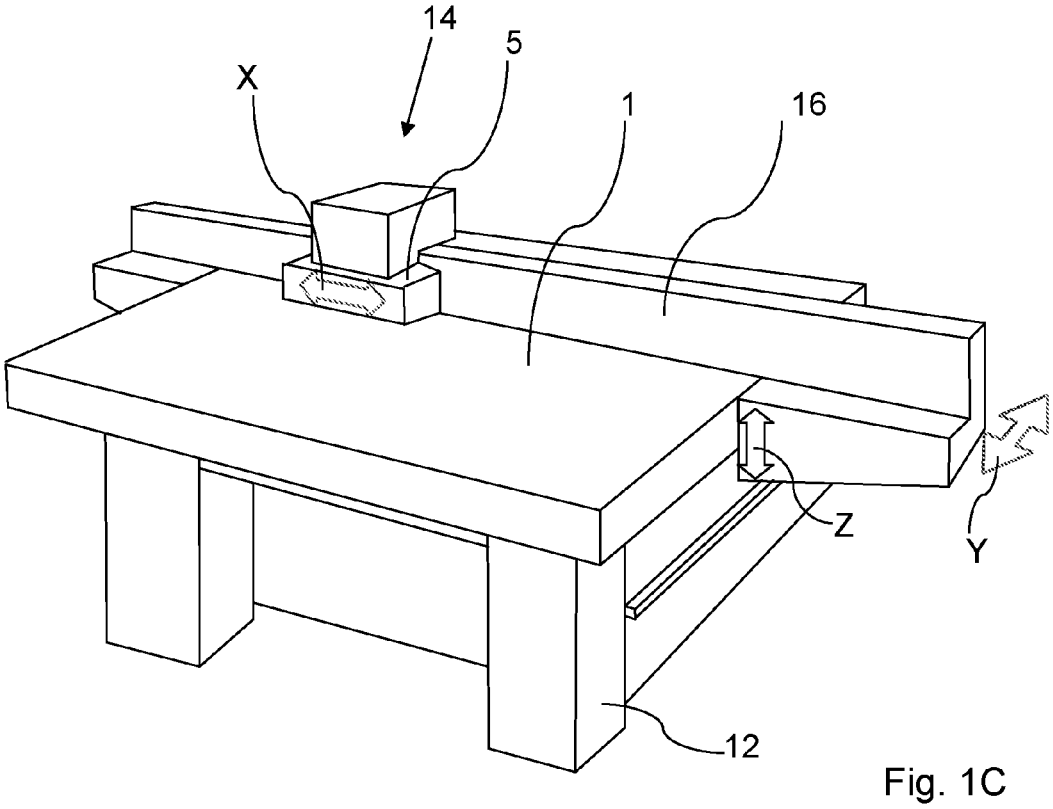
FIG. 1C is a perspective view of a second embodiment of an inkjet printing apparatus.

FIG. 1C shows another embodiment of an inkjet printing apparatus 14 (herein also referred to as a printing apparatus), in which the medium supporting means 1 is a flat surface. On the flat surface a non-flexible flat medium may be arranged and may be printed on. The medium supporting means 1 is supported on a suitable support structure 12 and a carriage guiding assembly 16 is arranged over the medium supporting means 1. Such carriage guiding assembly 16 is also known in the art as a gantry. The carriage guiding assembly supports the print head carriage 5 such that the print head carriage 5 is enabled to scan in an X-direction. The carriage guiding assembly 16 is arranged and configured to be enabled to reciprocate in a Y-direction, wherein the Y-direction is usually substantially perpendicular to the X-direction. In a known printing apparatus 14, the carriage guiding assembly 16 is also arranged and configured to be enabled to move in a Z-direction, which is substantially perpendicular to the X-direction and the Y-direction such to enable to adapt the printing apparatus 14 to a thickness of the recording medium being arranged on the medium supporting surface 1.

Figure 2:
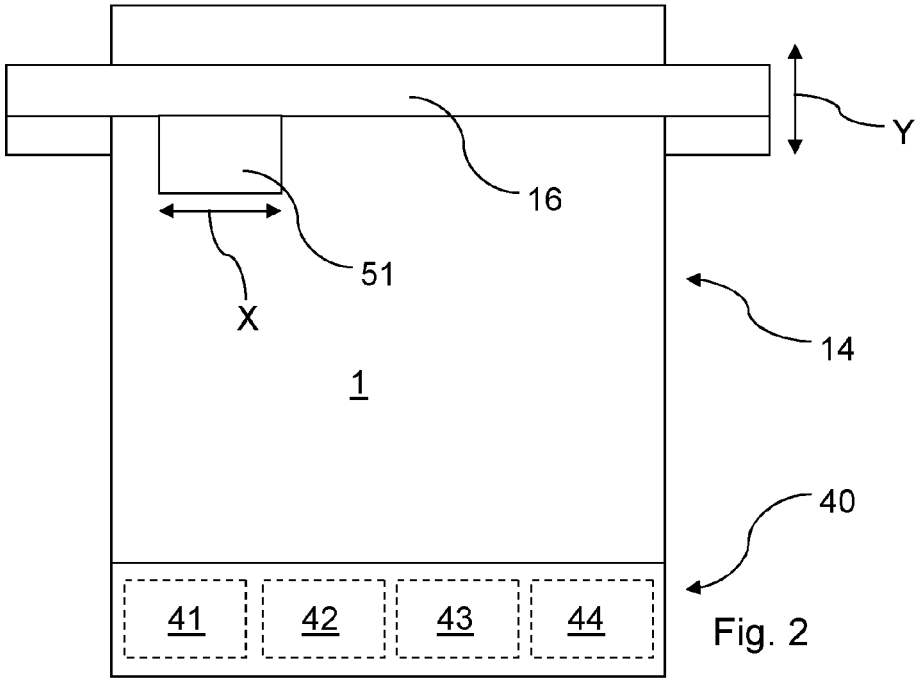
FIG. 2 is a top view of an embodiment of an inkjet printing apparatus according to the present invention.

FIG. 2 illustrates an embodiment of a printing apparatus 14 in accordance with the present invention. The printing apparatus 14 is provided with a carriage station 40 having a first, second, third and fourth carriage holding position 41, 42, 43 and 44. A detachable carriage 51 is operatively coupled to the gantry 16 through a carriage support (not shown in FIG. 2).

Similar to the printing apparatus 14, the carriage 51 is moveable in the X-direction and the gantry 16 is moveable in Y-direction. Thus, by suitably moving the carriage 51 along the gantry 16 and moving the gantry 16 over the medium support surface 1 a medium arranged on the medium support surface 1 may be printed on. If the gantry 16 is controllably moveable in the Z-direction during printing an image with elevations may be printed.

Figure 3A:
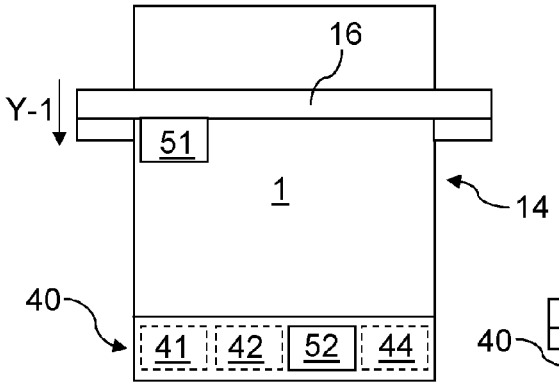
FIG. 3A-3F is a schematic top view illustration of an embodiment of a method of operation of an inkjet printing apparatus according to the present invention.

FIG. 3A-3F illustrate the operation of the printing apparatus 14 of FIG. 2 in more detail. FIG. 3A corresponds to FIG. 2 except that a second detachable carriage 52 is provided at the third carriage holding position 43 of the carriage station 40. For example, a first detachable carriage 51 is provided with four inkjet print heads for printing of cyan, magenta, yellow and black ink to form a full color image. For printing a varnish layer or a metallic ink layer or for performing a cutting operation, or the like, the second detachable carriage 52 may be provided with further inkjet print heads for printing varnish or a metallic ink or may be provided with a cutting unit. In order to apply the varnish or to perform the cutting operation, the first detachable carriage 51 needs to be disengaged at the carriage station 40 and the second detachable carriage 52 needs to engaged and attached. Thereto, the gantry 16 moves in the Y-direction (Y-1) towards the carriage station 40, while the first detachable carriage 51 is positioned (or moved to a position) opposite a free carriage holding position, in this case the first carriage holding position 41.

Figure 3B:
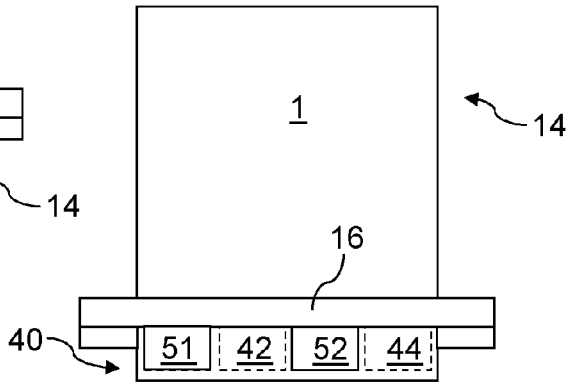

Eventually, as shown in FIG. 3B, the first detachable carriage 51 is positioned over the first carriage holding position 41. At that location, the first detachable carriage 51 may be disengaged from the carriage support 46 (see e.g. FIG. 3C).

Figure 3C:
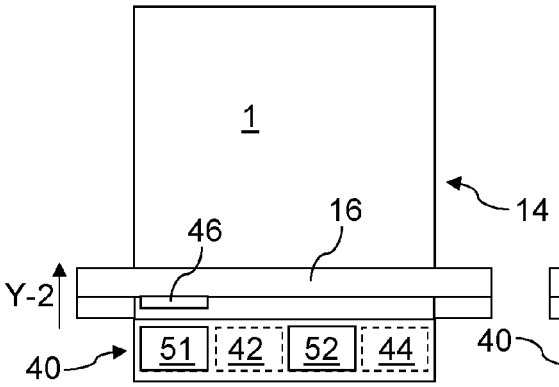
Figure 3D:
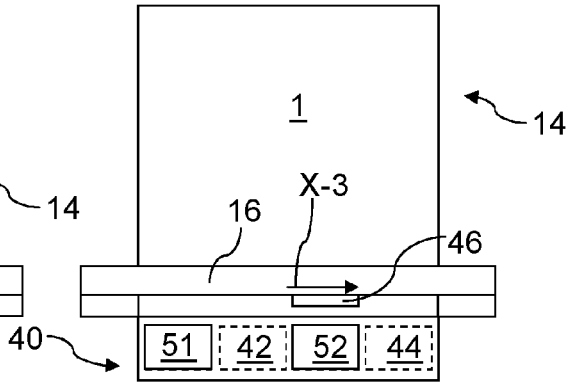

The first detachable carriage 51 having been disengaged, the gantry 16 moves in an opposite Y-direction (Y-2), as shown in FIG. 3C. Thus, as shown in FIG. 3D, the carriage support 46 is enabled to move in the X-direction (X-3) to a position in which the carriage support 46 is positioned opposite the second detachable carriage 52.

Figure 3E:
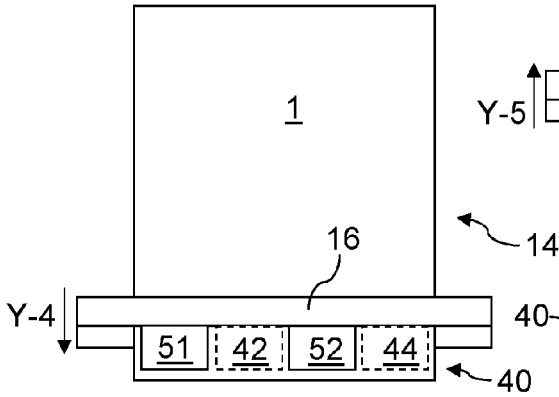

Subsequently, as shown in FIG. 3E, the gantry 16 moves towards the carriage station 40 in the Y-direction (Y-4) such that the carriage support 46 engages the second detachable carriage 52. Upon engaging, an operative coupling is established between the second detachable carriage 52 and the carriage support 46, including any electrical, mechanical and/or fluidic connections, where applicable.

Figure 3F:
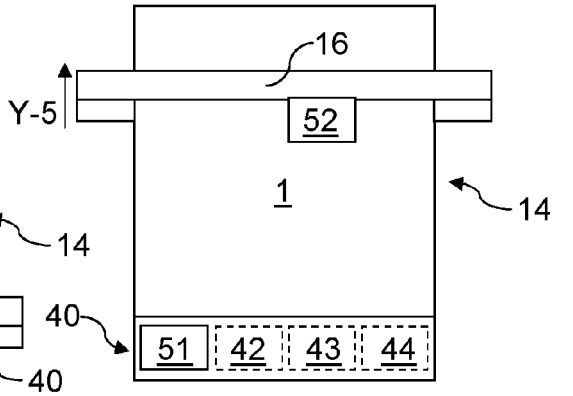

As shown in FIG. 3F, after engaging and establishing the required operative couplings, the gantry 16 can move away in the Y-direction (Y-5) from the carriage station 40 taking the second detachable carriage 52. Then, the printing assembly 14 is enabled to perform any operation corresponding to the units arranged on the second detachable carriage 52.

It is noted that the skilled person is enabled to use any common technology to provide for a suitable mechanical, electrical and/or fluidic coupling between the carriage support 46 and a detachable carriage 51, 52. Therefore, herein, such couplings are not described in more detail. Still, the specific kind of coupling, in particular the mechanical coupling, influences a need for specific calibration after having engaged and coupled the detachable carriage 51, 52.

If a highly accurate method of coupling the carriage support 46 and the detachable carriage 51, 52 is used, no specific calibration may be required, keeping the printing assembly as a whole simple and robust. However, it is contemplated that such a highly accurate coupling may be relatively costly and may require highly accurate movements of the gantry 16 and/or the carriage support 46. Such highly accurate movements may require a time-consuming method and may thus negatively influence the productivity of the printing assembly 14. To overcome such disadvantages, it is contemplated to use a less accurate coupling assembly and method, but to calibrate the resulting position relative to the medium support surface 1 and/or the carriage support 16. For example, the detachable carriages 51, 52 may be provided with predefined markers and the position of such markers may be determined after coupling. In another embodiment, the units arranged on the detachable carriages 51, 52 may be operated in a calibration position enabling to detect the position of the result and deriving from such position the position of the detachable carriage 51, 52. These and other calibration methods are deemed commonly available in the art and are not described in any more detail herein.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A flatbed printer assembly, the flatbed printer assembly comprising:

a. a medium support table for supporting a recording medium, the table extending in a first direction and a second direction, the first direction being perpendicular to the second direction;

b. a gantry arranged to be moveable over the medium support table in the first direction;

c. a carriage support for detachably coupling a carriage to the gantry, movably arranged on the gantry to move over the medium support table in the second direction;

d. a first carriage configured to be detachably coupled to the carriage support;

e. a carriage station having a first holding section for holding the first carriage when the first carriage is detached from the carriage support; and f. a second carriage configured to be detachably coupled to the carriage support, wherein the carriage station has a second holding section for holding the second carriage when the second carriage is detached from the carriage support, wherein the carriage support is configured to engage and disengage the first carriage at the first holding section of the carriage station and to engage and disengage the second carriage at the second holding section of the carriage station, and wherein at least one of the first carriage and the second carriage is provided with a printing unit for printing an image onto a recording medium supported by the medium support table.

2. The flatbed printer assembly according to claim 1, wherein the carriage station is provided with a printing unit maintenance assembly for performing a maintenance operation on the printing unit.

3. The flatbed printer assembly according to claim 1, wherein at least one carriage is provided with a non-printing unit for performing a non-printing operation on the recording medium other than printing an image.

4. The flatbed printer assembly according to claim 1, wherein the flatbed printer assembly is provided with a position alignment system, wherein the position alignment system is configured to accurately position the carriage relative to the carriage support, wherein the position alignment system comprises one of: a V-groove and a mating pin, a motorized drive or a voice coil based system.

5. A method of operating the flatbed printer assembly of claim 1, comprising:

providing the second carriage at the second holding section of the carriage station;

disengaging the first carriage from the carriage support at the first holding section of the carriage station;

after disengaging the first carriage, moving the carriage support from the first holding section of the carriage station to the second holding section of the carriage station;

engaging the second carriage with the carriage support at the second holding section of the carriage station; and performing a printing operation using the printing unit provided on at least one of the first carriage and the second carriage.

* * * * *